US007690812B2

(12) United States Patent
Roberts et al.

(10) Patent No.: US 7,690,812 B2
(45) Date of Patent: Apr. 6, 2010

(54) APPARATUS AND METHODS FOR CONFORMABLE DIFFUSE REFLECTORS FOR SOLID STATE LIGHTING DEVICES

(75) Inventors: John K. Roberts, Grand Rapids, MI (US); Chenhua You, Cary, NC (US); Paul E. Sims, Pittsboro, NC (US)

(73) Assignee: Cree, Inc., Durham, NC (US)

( * ) Notice: Subject to any disclaimer, the term of this patent is extended or adjusted under 35 U.S.C. 154(b) by 342 days.

(21) Appl. No.: 11/687,160

(22) Filed: Mar. 16, 2007

(65) Prior Publication Data

US 2008/0225553 A1 Sep. 18, 2008

(51) Int. Cl.
*F21V 33/00* (2006.01)

(52) U.S. Cl. ..... 362/247; 362/800; 362/219; 362/296.01

(58) Field of Classification Search ..... 362/616, 362/800, 219, 238, 241, 247, 296
See application file for complete search history.

(56) References Cited

U.S. PATENT DOCUMENTS 5,226,723 A * 7/1993 Chen ..... 362/241
2002/0141181 A1* 10/2002 Bailey ..... 362/150
2006/0131602 A1* 6/2006 Ouderkirk et al. ..... 257/100
2006/0187660 A1* 8/2006 Liu ..... 362/294

FOREIGN PATENT DOCUMENTS

DE 20 2004 006389 7/2004
WO WO 2007/061788 A1 5/2007

OTHER PUBLICATIONS

International Search Report, PCT/US2008/003074 dated Jul. 3, 2008.

* cited by examiner

*Primary Examiner*—Laura Tso
(74) *Attorney, Agent, or Firm*—Myers Bigel Sibley & Sajovec

(57) ABSTRACT

Provided are solid state lighting devices and methods for forming the same. A solid state lighting tile according to some embodiments of the invention includes a substrate, a solid state lighting element mounted on a surface of the substrate, and a reflector sheet on the surface of the substrate. A method of forming a solid state lighting device according to some embodiments of the invention includes providing a substrate of a solid state lighting tile, mounting a solid state lighting element on a surface of the substrate, and attaching a reflector sheet to the surface of the substrate.

24 Claims, 5 Drawing Sheets

APPARATUS AND METHODS FOR CONFORMABLE DIFFUSE REFLECTORS FOR SOLID STATE LIGHTING DEVICES

FIELD OF THE INVENTION

The present invention relates to solid state lighting, and more particularly to tiles and/or panels including solid state lighting components.

BACKGROUND

Panel lighting devices are used for a number of lighting applications. A lighting panel may be used, for example, as a backlighting unit (BLU) for an LCD display. Backlighting units commonly rely on an arrangement of cold cathode fluorescent lamps (CCFL's) within a reflective enclosure. For example, referring to FIG. 1, which is a side view of a backlighting unit of the prior art, multiple CCFL's 1 can be arranged between a reflective surface 2 and an LCD panel 3. Light from the CCFL's 1 can be reflected from the reflective surface 2 and partially reflected from the inside surface of the LCD panel 3. A portion of the light directed to the LCD panel 3 can transmitted to provide illumination for the LCD panel 3. The combination of the light directly transmitted to the LCD panel 3 from the CCFL's 1 and the reflected light from the various surfaces can create a relatively uniform backlighting unit. The CCFL's 1 however, can require higher than signal level voltages and can generate undesirable amounts of heat, which can be problematic to dissipate.

SUMMARY

A solid state lighting tile according to some embodiments of the invention includes a substrate, a solid state lighting element mounted on a surface of the substrate, and a reflector sheet on the surface of the substrate.

The reflector sheet may be a diffuse reflector and/or may be composed of a porous polymer-based material. The reflector sheet may have a thickness of less than approximately 1.0 millimeters, a thickness of less than approximately 0.50 millimeters and/or a thickness of less than approximately 0.25 millimeters.

The solid state lighting tile may further include a mechanical fastening device configured to attach the reflector sheet to the surface of the substrate. In some embodiments the mechanical fastening device can be a mechanical expansion-activated fastener. In yet other embodiments, the mechanical fastening device can include mounting posts that are integral with the reflector sheet.

A solid state lighting tile according to further embodiments can include a chemical bonding component configured to attach the reflector sheet to the surface of the substrate. The chemical bonding component can include glue and/or a pressure sensitive adhesive compound.

The reflector sheet of yet further embodiments can be configured to conform to a shape of a protruding feature on the tile. In yet further embodiments, the reflector sheet can include an aperture configured to be positioned proximate to the solid state lighting element, wherein the reflector sheet does not contact the solid state lighting element.

A solid state lighting tile according to yet further embodiments can include a first reflector sheet that includes a first angularly deflected edge and a first adjacent edge and a second reflector sheet that includes a second angularly deflected edge and a second adjacent edge, wherein the first angularly deflected edge is configured to overlap the second adjacent edge when the first reflector sheet is proximate to the second reflector sheet.

In yet further embodiments, a solid state light bar includes multiple solid state lighting tiles, wherein a single reflector sheet is configured to cover the multiple tiles of the solid state light bar.

Methods of forming a solid state lighting device according to some embodiments of the invention include providing a substrate of a solid state lighting tile, mounting a solid state lighting element on a surface of the substrate, and positioning a reflector sheet on the surface of the substrate.

In some embodiments, positioning the reflector sheet may include chemically bonding the reflector sheet to the surface of the substrate and/or mechanically attaching the reflector sheet to the surface of the substrate. In some embodiments, the reflector sheet can include an aperture configured to be positioned over the solid state lighting element, wherein the reflector sheet does not contact the solid state lighting element. In yet other embodiments, the reflector sheet is thermoformable and configured to conform to a shape of a protruding feature on the surface of the substrate.

The method may further include forming a plurality of mounting posts in the substrate and forming a plurality of alignment holes in the reflector sheet, wherein at least a portion of the alignment holes are configured to receive at least a portion of the mounting posts when the reflector sheet is attached to the surface of the substrate.

Some embodiments of the method further include providing a plurality of solid state lighting tiles, mounting a plurality of solid state lighting elements on the plurality of solid state lighting tiles, and attaching the reflector sheet to the plurality of solid state lighting tiles.

The methods may further include overlapping a top surface of an angularly deflected edge of a first reflector sheet attached to a first tile with a bottom surface proximate to an adjacent edge of a second reflector sheet attached to a second tile when the first tile is of the second tile.

BRIEF DESCRIPTION OF THE DRAWINGS

The accompanying drawings, which are included to provide a further understanding of the invention and are incorporated in and constitute a part of this application, illustrate certain embodiment(s) of the invention.

DETAILED DESCRIPTION OF EMBODIMENTS OF THE INVENTION

Figure 1:
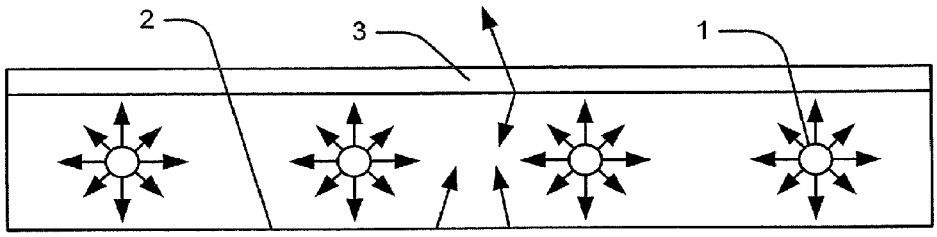
FIGURE 1 (Prior Art)
FIG. 1 is a side view of a CCFL backlighting panel as known in the prior art.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to flowchart illustrations and/or block diagrams of methods, systems and computer program products according to embodiments of the invention. It will be understood that some blocks of the flowchart illustrations and/or block diagrams, and combinations of some blocks in the flowchart illustrations and/or block diagrams, can be implemented by computer program instructions. These computer program instructions may be stored or implemented in a microcontroller, microprocessor, digital signal processor (DSP), field programmable gate array (FPGA), a state machine, programmable logic controller (PLC) or other processing circuit, general purpose computer, special purpose computer, or other programmable data processing apparatus such as to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Figure 2:
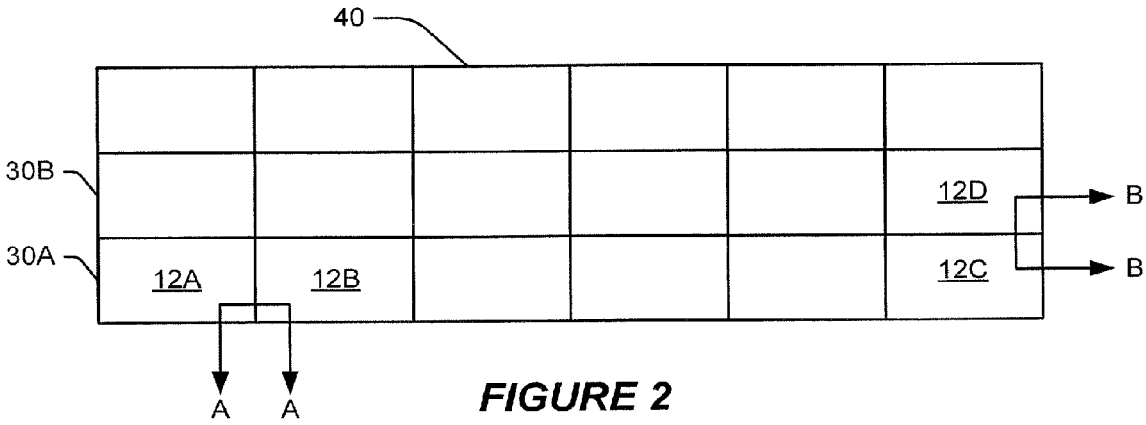
FIG. 2 is a top view of a solid state lighting panel in accordance with some embodiments of the invention.

A solid state lighting device may include, for example, a packaged light emitting device including one or more light emitting diodes (LEDs). For example, referring to FIG. 2, a solid state lighting panel 40 can include multiple solid state lighting bars 30A, 30B that can further include multiple solid state lighting tiles 12A, 12B.

Figure 3:
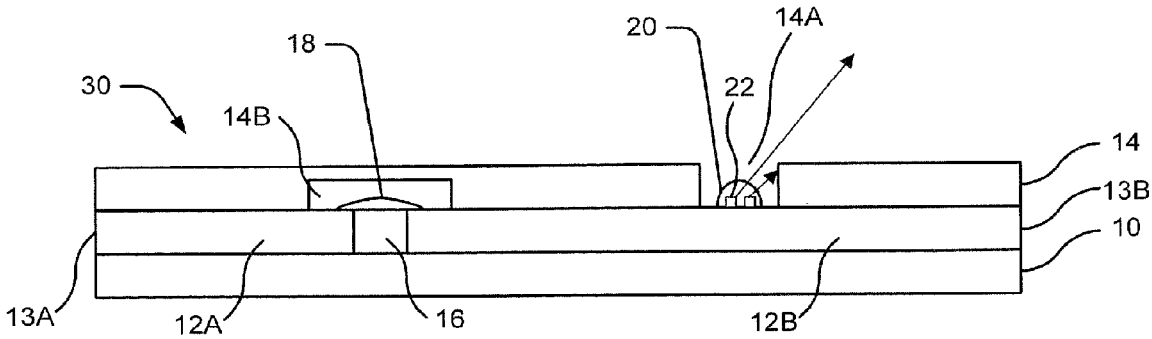
FIG. 3 is a side cross-sectional view of a solid state lighting bar in accordance with some embodiments of the invention.

A solid state lighting bar 30, as illustrated in FIG. 3, can include a support member 10, on which is provided solid state lighting tile substrate 13B that corresponds to solid state lighting tile 12B. The tile 12B can also include a solid state emitter 20 mounted on a surface of the substrate 13B. The emitter 20 can include one or more LED emitter chips 22 that are configured to emit light having one or more wavelengths. The tile 12B also includes a reflector sheet 14, configured to reflect and diffuse light transmitted from the emitter 20. The reflector sheet 14 can be configured to cover multiple tiles 12A, 12B of the solid state lighting panel 40. The substrates 13A, 13B can also include surface protrusions, such as, for example, a large wire interconnect (LWI) 18. A LWI 18 can be used to provide electrical interconnections for tiles 12A and 12B. Adjacent the LWI 18 can be an optional insulating plug 16 that can mechanically join and electrically insulate adjacent tiles 12A and 12B. The LWI 18 may be electrically insulated and/or protected from environmental exposure with a passivation or encapsulation material, including, for example, silicone (not shown).

After the bars 30 of tiles 12 are assembled into a two dimensional structure, a reflector sheet 14 may be mounted on the multiple bars. The reflector sheet 14 may be microcellular polyethylene terephthalate (MCPET), which may have a typical thickness of approximately 1 mm. The reflector sheet 14 may include recesses 14B configured to provide relief for surface protrusions, such as an LWI 18. The recesses 14B may be molded into the reflector sheet 14 and/or created by removing material from the reflector sheet as a step in a manufacturing process. Without the recesses 14B, the reflector sheet 14 can press against the LWI, potentially causing the LWI to break or pull away from the substrate 13. The reflector sheet 14 may also include apertures 14A that are configured to be aligned with the emitters 20. Since the thickness of the reflector sheet 14 may be large compared to the size of the emitter 20, emitted light may be partially blocked by the reflector sheet 14. For example, low angle light that is emitted by an LED emitter chip 22 that is close to the edge of the aperture 14A may be partially blocked while, low angle light from another LED emitter chip 22 is may not be blocked. As a result, light emitted by the lighting panel 40 may not have a uniform color in all angular directions. Furthermore, small changes in alignment of the aperture 14A relative to the emitter 20 may have relatively large effects on the light output pattern of the lighting panel 40.

Figure 4:
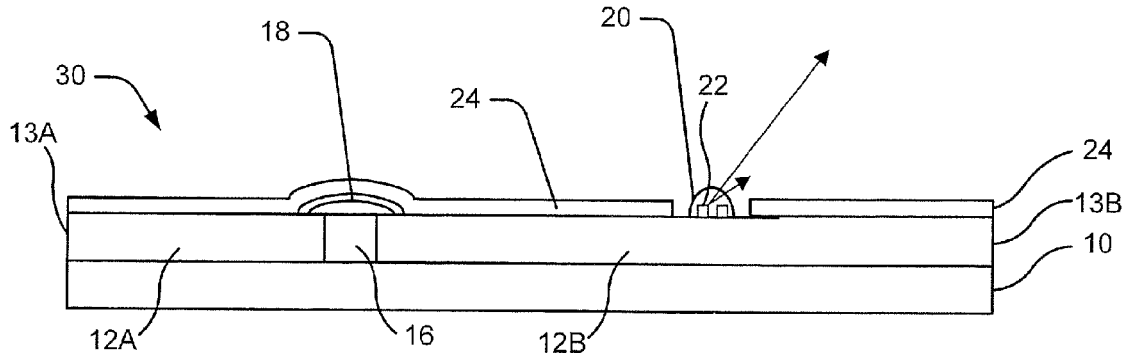
FIG. 4 is a partial, side cross-sectional view of a solid state lighting bar, taken along lines A-A of FIG. 1, illustrating a reflector sheet according to some embodiments of the invention.

Reference is now made to FIG. 4, which is a partial, side cross-sectional view of a solid state lighting bar 30, taken along lines A-A of FIG. 1, illustrating a reflector sheet according to some embodiments of the invention. The solid state lighting bar 30 includes a first substrate 13A corresponding to a first tile 12A and a second substrate 13B corresponding to a second tile 12B. Each of the first and second substrates 13A and 13B are mounted on a support member 10. The support member 10 can be configured to provide support for the tiles 12 that are included, for example, in the solid state lighting bar 30. A tile 12 may include, for example, a printed circuit board (PCB) on which one or more circuit elements may be mounted. The first and second substrates 13A and 13B can be separated by an insulating plug 16, that can be configured to mechanically join and electrically insulate the first and second tiles 12A and 12B.

The solid state lighting bar 30 can also include one or more large wire interconnects 18 (LWI)'s that can be positioned, for example, proximate to an insulating plug 16. The LWI 18 is but one example of a surface protrusion that can occur on a surface of the tile substrate. Although illustrated as a protrusion, in some embodiments the LWI 18 may be flush with the surface of the tiles 12, in which case the relief are 14B may be unnecessary. A solid state emitter 20 can be mounted on a surface of the substrate 13B. The solid state emitter 20 can include multiple LED emitter chips 22, which can be configured to emit light having one or more wavelengths.

A reflector sheet 24 can be positioned on the substrate 13 of one or more tiles 12. For example, the reflector sheet 24 can be configured to cover a single tile 12 and/or a solid state lighting bar 30. In some embodiments the reflector sheet 24 may be positioned directly on the substrate. In some embodiments, the reflector sheet 24 may be attached to a housing and not attached to the substrate. For example, the reflector sheet 24 may be bonded to a support structure near the edges of the reflector sheet 24. While the solid state lighting bar 30 shown in FIG. 1 is a one dimensional array of tiles 12, other configurations are possible. For example, the tiles 12 could be connected in a two-dimensional array in which the tiles 12 are all located in the same plane, or in a three dimensional configuration in which the tiles 12 are not all arranged in the same plane. Furthermore, the tiles 12 need not be rectangular or square, but could, for example, be hexagonal, triangular, or the like. In this manner, the reflector sheet 24 that is configured to cover a single tile 12, can be used in a variety of solid state lighting bar 30 and/or lighting panel 40 configurations.

The reflector sheet 24 can be held in place on the tile 12 and/or bar 30 using mechanical and/or chemical bonding techniques. Chemical bonding can include, for example, pressure sensitive adhesive and/or glue. Examples of mechanical techniques include rivets, heat stakes, push-pins, and/or mounting posts that are formed as an integral part of the reflector sheet 24 and/or substrate 13. Mounting posts can be formed using, for example, injection molding manufacturing techniques.

The reflector sheet 24 can be a diffuse reflector and can be formed using a microporous structure of a polymer material, such as micro-cellular polyethylene terephthalate (MCPET) that is commercially available from Furukawa Electric Co., Ltd. In some embodiments, while not thermoformable, DRP® reflectors that are commercially available from W. L. Gore and Associates, Inc. may be used as a reflector sheet 24. In some embodiments, the reflector sheet 24 may be a sheet and/or film that is polymeric, elastomeric, thermoplastic and/or thermoset, among others. The reflector sheet 24 can be used in thicknesses including approximately 1.0 millimeters, approximately 0.50 millimeters and approximately 0.25 millimeters, for example. The small thickness of the reflector sheet 24 relative to the emitter 20 can result in a reduction of low-angle light blocking, which may provide for better color uniformity of the solid state lighting panel 40. Additionally, the reflector sheet 24 includes a deformation characteristic that can provide conformance to surface protrusions such as an LWI 18. Further, since the reflector sheet 24 can be attached to individual tiles 12 and/or solid state lighting bars 30, assembly of the solid state lighting panel 40 may be simplified.

Figure 5A:
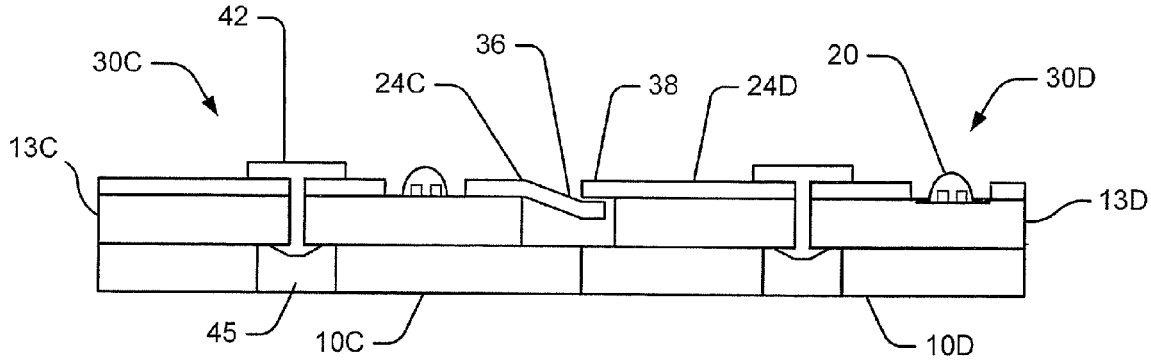
FIG. 5 is a partial, end cross-sectional view of a solid state lighting panel, taken along lines B-B of FIG. 1, illustrating reflector sheets according to some embodiments of the invention.
Figure 5B:
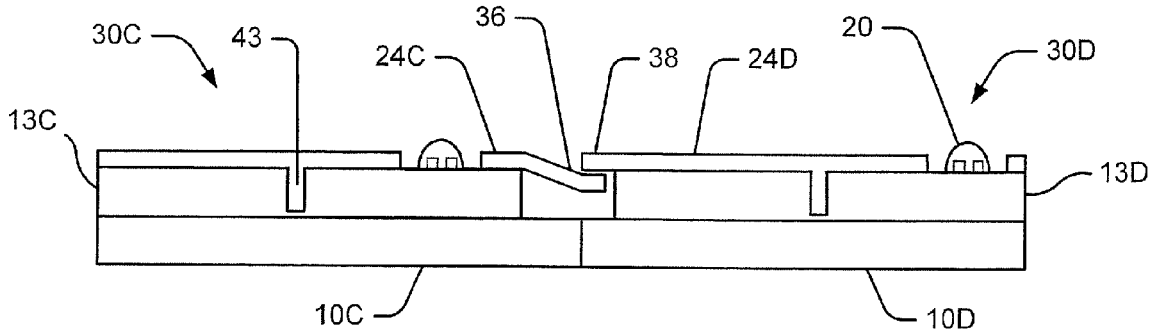

Reference is now made to FIGS. 5A and 5B, which are partial, end cross-sectional views of a solid state lighting panel 40 taken along lines B-B of FIG. 1 and illustrating a conformable reflector sheet according to some embodiments of the invention. The lighting panel 40 includes solid state lighting bars 30C and 30D, which each include support members 10C and 10D, substrates 13C and 13D, and reflector sheets 24C and 24D. The solid state lighting bars 30 of FIG. 5A can also include plastic rivets 42 configured to hold the reflector sheets 24 in place relative to the substrates 13. The rivets 42 can include retention flanges that can contact a bottom side of the substrates 13C and 13D. The support members 10C and 10D can include recesses 45 corresponding to the retention flanges of the rivets 42. As illustrated in FIG. 5B, the solid state lighting bars 30 can also include reflector sheets 24 having integrated push-pins 43 that are formed as portions of the reflector sheets 24 to hold the reflector sheets 24 in place relative to the substrates 13. For example, the reflector sheet 24 may be injection molded such that the rivet 42 is a component of the reflector sheet 24. In this manner, the reflector sheet 24 can be snapped onto the bar 13 via the rivets 42 and/or push-pins 43. In some embodiments, the solid state lighting bars 30 can include integrated rivets and/or nonintegrated push-pins (not illustrated).

In some embodiments, the push-pins 43 may be formed of a white colored material, such as nylon and/or the same material as the reflector sheet 24, for example, PET plastic. In that way, the push-pin 43 may provide the same or similar reflectance as the reflector sheet 24, thereby providing a more uniform light output. Moreover, since the function of the push-pins 43 may only be to hold the lightweight reflector sheet 24 in place on the solid state lighting bar 30, the push-pins 43 may grip the reflector sheet 24 relatively lightly, an may not significantly deform the surface of the reflector sheet 24, thereby potentially improving the uniformity of the light output.

The head of a rivet 42 and/or push-pin 43 may have a low profile, such that the head may be positioned nearly flush with the reflector sheet 24 when the rivet 42 is in place. Accordingly, the rivet 42 and/or push-pin 43 may act as a functional extension of the reflector sheet 24. Furthermore, the head of the rivet 42 and/or push-pin 43 may be made low so as not to substantially shadow light emitted from an emitter on a solid state lighting bar 13.

While rivets and push-pins are discussed, a variety of mechanical expansion-activated fasteners may be used. Additionally, each reflector sheet 24C may include an angularly deflected edge 36 that may be configured to be overlapped by an adjacent edge 38 of a reflector sheet 24D on an adjacent tile 12. By way of example, the adjacent edge 38 may be undeflected and/or deflected in a similar or complementary manner.

Figure 6:
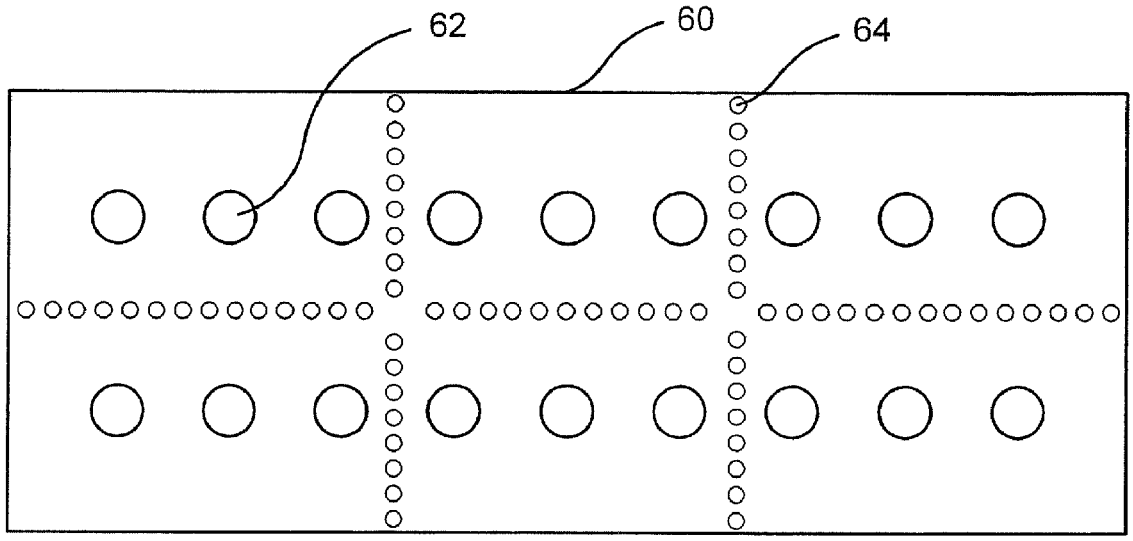
FIG. 6 is a top view of a reflector sheet according to some embodiments of the invention.

Brief reference is now made to FIG. 6, which is a top view of a reflector sheet according to some embodiments of the invention. The reflector sheet 60 includes multiple apertures 62 for receiving emitters on one or more solid state lighting bars. The reflector sheet 60 also can include multiple perforation apertures 64 that may be configured in patterns arranged in one or more dimensions across the reflector sheet 60. The perforation apertures 64 can serve to provide designated expansion zones in the event that the solid state lighting bars experience thermal expansion and/or contraction. In this manner, expansion and/or contraction can be isolated to the designated expansion zones in order to reduce buckling, warping, and/or distortion that might undesirably affect uniformity.

Figure 7:
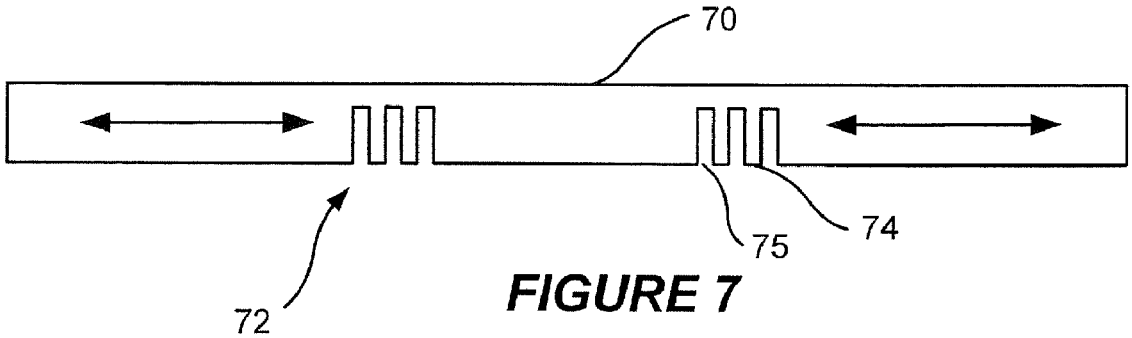
FIG. 7 is a side view of a reflector sheet according to some embodiments of the invention.

Thermal expansion zones may also be created by varying the thickness of the reflector sheet 70, as illustrated in FIG. 7, which is a side view of a reflector sheet according to some embodiments of the invention. The reflector sheet 70 may include expansion zones 72 configured to provide designated areas in which thermal expansion and/or contraction can occur. The expansion zone 72 can include multiple ribs 74 that define channels 75 having a reduced thickness. By defining an expansion zone 72, the reflector sheet 70 can be more capable of expanding and/or contracting with changes in temperature without excessive stress or deformation.

Figure 8:
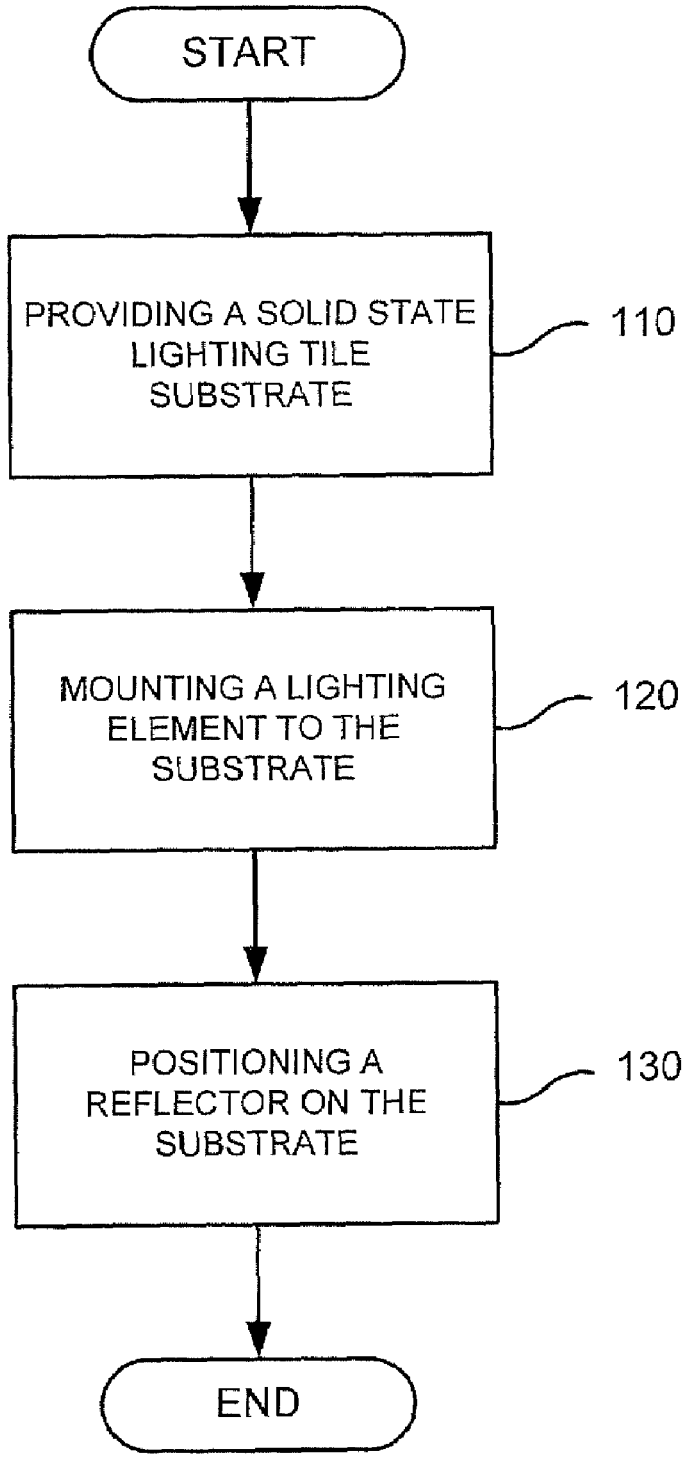
FIG. 8 is a block diagram illustrating methods of forming a solid state lighting device according to some embodiments of the invention.

Reference is now made to FIG. 8, which is a block diagram illustrating a method of forming a solid state lighting device according to some embodiments of the invention. A solid state lighting tile substrate is provided (block 110). The substrate can be mounted on, for example, a support member that is configured to support one or more tile substrates. Multiple tiles can be configured as a solid state lighting bar, which can, in combination with other solid state lighting bars, be configured as a solid state lighting panel.

A lighting element is mounted to the substrate (block 120). The lighting element can be a solid state emitter that can include one or more LED emitter chips. In some embodiments, each of the LED emitter chips can be configured to transmit light at specific wavelengths. A reflector sheet can be positioned on the substrate (block 130). In some embodiments, the reflector sheet may include materials that are formable including, for example, thermoformable materials. The reflector sheet can include one or more apertures configured to be aligned with lighting elements. The reflector sheet can also be configured to conform to protrusions on the surface of the substrate, such as LWI's, for example. In some embodiments, the reflector sheet can have a thickness less than approximately 1.0 millimeter. In some embodiments, the reflector sheet can have a thickness less than approximately 0.50 millimeters.

Figure 9:
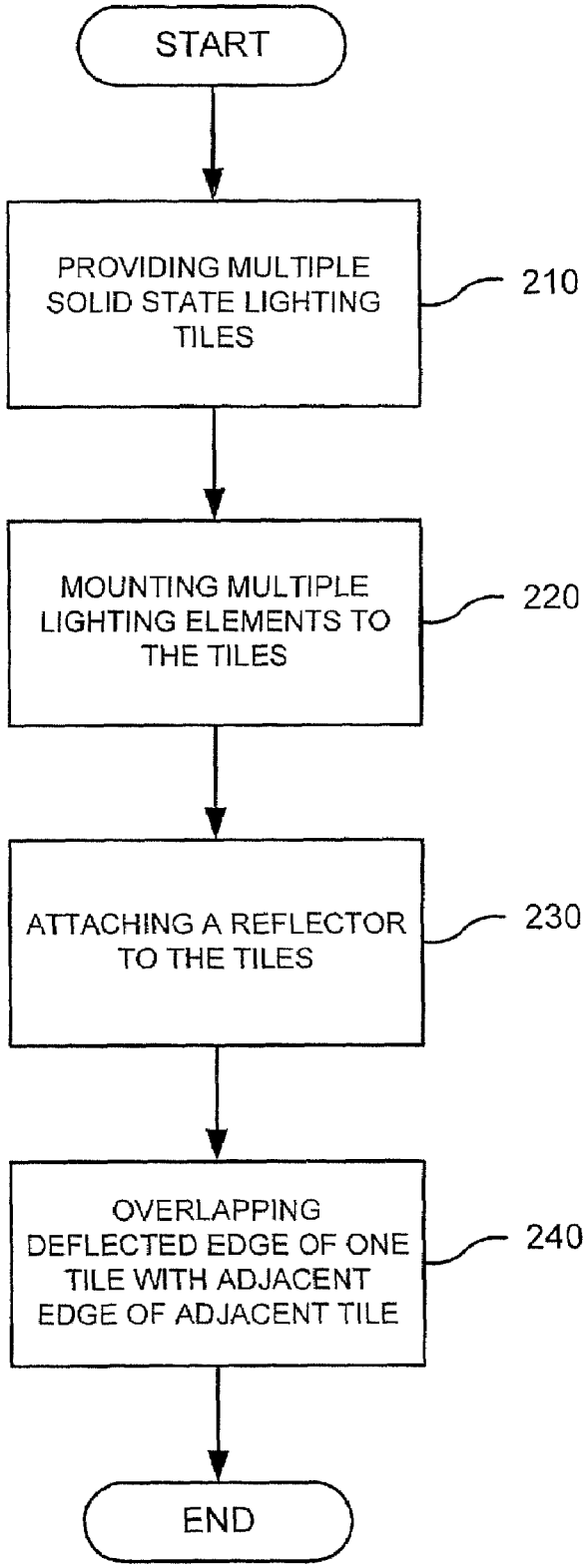
FIG. 9 is a block diagram illustrating further methods of forming a solid state lighting device according to some embodiments of the invention.

Reference is now made to FIG. 9, which is a block diagram illustrating further methods of forming a solid state lighting device according to some embodiments of the invention. Multiple solid state lighting tiles are provided (block 210). The tiles can be supported by, for example, a support member that corresponds to a solid state lighting bar. Multiple lighting elements are mounted to the tiles (block 220). The lighting elements can be solid state emitters that can include one or more LED emitter chips. A reflector sheet is attached to the multiple tiles (block 230). The reflector sheet can include apertures that are configured to be aligned with the lighting elements. In some embodiments, the reflector sheet can have a thickness of less than approximately 0.25 millimeters. Additionally, the reflector sheet may be configured to conform to protrusions on the surface of the tile substrate. In this manner, recesses may not have to be created or formed in the reflector sheet during manufacturing. A deflected edge of a reflector sheet on a first tile is made to overlap an adjacent edge of the reflector sheet of an adjacent tile (block 240). The adjacent edge can be undeflected or deflected in a similar or complementary manner, for example. In this manner, the reflector sheet of the first tile is overlapped by the reflector sheet of the second tile when the tiles are assembled to create a display or panel.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A solid state lighting tile, comprising:

a substrate;

a solid state lighting element mounted on a surface of the substrate; and a reflector sheet on the surface of the substrate, the reflector sheet configured to conform to a shape of a protruding feature on the tile.

2. The tile of claim 1, wherein the reflector sheet comprises a diffuse reflector.

3. The tile of claim 1, wherein the reflector sheet comprises a polymer-based porous material.

4. The tile of claim 1, wherein the reflector sheet comprises a thickness of less than approximately 1.0 millimeter.

5. The tile of claim 1, wherein the reflector sheet has a thickness of less than approximately 0.50 millimeters.

6. The tile of claim 1, wherein the reflector sheet has a thickness of less than approximately 0.25 millimeters.

7. The tile of claim 1, further comprising a mechanical fastening device configured to attach the reflector sheet to the surface of the substrate.

8. The tile of claim 7, wherein the mechanical fastening device comprises a mechanical expansion-activated fastener.

9. The tile of claim 7, wherein the mechanical fastening device comprises mounting posts that are integral with the reflector sheet.

10. The tile of claim 1, further comprising a chemical bonding component configured to attach the reflector sheet to the surface of the substrate.

11. The tile of claim 10, wherein the chemical bonding component comprises glue and/or a pressure sensitive adhesive compound.

12. The tile of claim 1, wherein the reflector sheet comprises an aperture configured to be positioned proximate to the solid state lighting element, wherein the reflector sheet does not contact the solid state lighting element.

13. A solid state lighting tile, comprising:

a substrate;

a solid state lighting element mounted on a surface of the substrate; and a reflector sheet on the surface of the substrate wherein the reflector sheet comprises an aperture configured to be positioned proximate to the solid state lighting element, wherein the reflector sheet does not contact the solid state lighting element, and wherein a first reflector sheet comprises a first angularly deflected edge and a first adjacent edge and a second reflector sheet comprises a second angularly deflected edge and a second adjacent edge, wherein the first angularly deflected edge is configured to overlap the second adjacent edge when the first reflector sheet is proximate to the second reflector sheet.

14. A solid state light bar comprising a plurality of tiles according to claim 1, wherein a single reflector sheet is configured to cover the plurality of tiles of the solid state light bar.

15. A method of forming a solid state lighting device comprising:

providing a substrate of a solid state lighting tile;

mounting a solid state lighting element on a surface of the substrate; and positioning a reflector sheet on the surface of the substrate, the reflector sheet configured to conform to a shape of a protruding feature on the solid state lighting tile.

16. The method of claim 15, wherein positioning the reflector sheet comprises chemically bonding the reflector sheet to the surface of the substrate.

17. The method of claim 15, wherein positioning the reflector sheet comprises mechanically attaching the reflector sheet to the surface of the substrate.

18. The method of claim 15, wherein the reflector sheet comprises an aperture configured to be positioned over the solid state lighting element, wherein the reflector sheet does not contact the solid state lighting element.

19. The method of claim 15, wherein the reflector sheet is thermoformable and configured to conform to a shape of a protruding feature on the surface of the substrate.

20. A method of forming a solid state lighting device comprising:

providing a substrate of a solid state lighting tile;

mounting a solid state lighting element on a surface of the substrate;

positioning a reflector sheet on the surface of the substrate;

forming a plurality of mounting posts in the substrate; and forming a plurality of alignment holes in the reflector sheet, wherein at least a portion of the alignment holes are configured to receive at least a portion of the mounting posts when the reflector sheet is attached to the surface of the substrate.

21. The method of claim 15, wherein the reflector sheet comprises a diffuse reflector.

22. The method of claim 15, wherein the reflector sheet comprises: a micro-porous polymer; and an expansion zone configured to provide a designated area for expansion.

23. The method of claim 16, further comprising:

providing a plurality of solid state lighting tiles;

mounting a plurality of solid state lighting elements on the plurality of solid state lighting tiles; and attaching the reflector sheet to the plurality of solid state lighting tiles.

24. A method of forming a solid state lighting device comprising;

providing a substrate of a solid state lighting tile;

mounting a solid state lighting element on a surface of the substrate;

positioning a reflector sheet on the surface of the substrate; and overlapping a top surface of an angularly deflected edge of a first reflector sheet attached to a first tile with a bottom surface of an adjacent edge of a second reflector sheet attached to a second tile when the first tile is proximate to the second tile.

* * * * *